US006012631A

United States Patent [19]

Hallam

[11] Patent Number: 6,012,631

[45] Date of Patent: Jan. 11, 2000

[54] CARTONS

[75] Inventor: Christopher Hallam, Halifax, United Kingdom

[73] Assignee: Concept Packaging Limited, Halifax, United Kingdom

[21] Appl. No.: 09/028,048

[22] Filed: Feb. 23, 1998

[30] Foreign Application Priority Data

Feb. 22, 1997 [GB] United Kingdom ..... 9703735

[51] Int. Cl.[7] ..... B65D 5/20

[52] U.S. Cl. ..... 229/163; 229/113; 229/116.1; 229/172

[58] Field of Search ..... 229/163, 172, 229/909, 113, 192, 116.1; 206/424

[56] References Cited

U.S. PATENT DOCUMENTS

| | | | |
|---|---|---|---|
| 1,332,204 | 3/1920 | Diamond | 229/163 |
| 1,833,057 | 11/1931 | Tanner | 229/113 |
| 2,061,992 | 11/1936 | Wilson | 229/116.1 |
| 3,311,285 | 3/1967 | Korr | 229/172 |
| 3,478,949 | 11/1969 | Richgels | 229/163 |
| 3,902,653 | 9/1975 | Persson | 229/192 |
| 4,090,608 | 5/1978 | McCall | 206/424 |
| 4,258,881 | 3/1981 | Mode et al. | 229/163 |
| 5,248,037 | 9/1993 | Kornberg et al. | 229/116.1 |
| 5,586,717 | 12/1996 | Hallam . | |

FOREIGN PATENT DOCUMENTS

| | | | |
|---|---|---|---|
| 833033 | 4/1960 | United Kingdom | 229/163 |

*Primary Examiner*—Gary E. Elkins
*Attorney, Agent, or Firm*—Venable; George H. Spencer; Allen Wood

[57] ABSTRACT

The present application discloses a carton (2) which includes a base panel (12) having an outer portion and a side wall (38, 40) that is generally perpendicular to the base panel. The base panel includes a marginal flange (34) that is foldably connected to the outer portion of the base panel, which marginal flange overlies the base panel. The side wall includes a marginal flange that is foldably connected thereto, which side wall marginal flange overlies the base panel marginal flange. The base panel marginal flange is secured to the base panel or to the side wall marginal flange. The invention extends to a one-piece "book-pack" type carton and to corner constructions.

10 Claims, 4 Drawing Sheets

CARTONS

FIELD OF THE INVENTION

The present invention relates to cartons, carton blanks and aspects of carton construction. More particularly, though not exclusively, it relates to cartons of the "book pack" type. A "book pack" type carton is intended in its external appearance somewhat to resemble a book, the carton including a base which extends beyond the walls of a rectangular body and an openable cover overlapping the rectangular body, with a spine between the base and the cover.

BACKGROUND OF THE INVENTION

It is known from United States patent no. U.S. Pat. No. 5,586,717 (Hallam) to provide a "book pack" type carton construction in two pieces. The first piece is the body, a four sided box with a base, and the second piece is the cover adhered to the base of the body. A specially designed sliding tongue-and-slot arrangement is provided to accommodate movement between the cover and the body during opening of the moveable flap of the cover.

U.S. Pat. No. 5,586,717 (Hallam) has the disadvantage that it is a two piece construction and needs a relatively complex arrangement to enable the cover to open and close neatly.

The present invention aims to obviate or overcome disadvantages of the prior art, whether referred to herein or otherwise.

SUMMARY OF THE INVENTION

One of the significant difficulties encountered in producing a practical one-piece "book pack" type carton is the design of the base extending beyond the body portion. This difficulty has been addressed by the present inventor using a fold construction providing little strain and considerable gluing area.

According to the present invention in a first aspect, there is provided an extension edge of a carton comprising a base panel having an outer portion and a side wall generally perpendicular to the base panel, the base panel comprising a marginal flange foldably connected to the outer portion of the base panel, which marginal flange overlies the base panel, the side wall comprising a marginal flange foldably connected thereto, which side wall marginal flange overlies the base panel marginal flange, in which the base panel marginal flange is secured to the base panel or to the side wall marginal flange.

This arrangement provides additional gluing area away from the edge of the carton thus more securely holding the construction together and restricting unsightly deformations.

Suitably, the base panel marginal flange extends beyond the side wall marginal flange. Suitably, the base panel marginal flange extends from one side of the side wall to substantially beyond the other side of the side wall, thus providing substantial gluing area and reducing strains induced by the folds and scores.

Suitably, the base panel marginal flange is integrally connected to the side wall marginal flange. Suitably, the base panel marginal flange is foldably connected to the side wall marginal flange. Suitably, the extension edge is of a one-piece construction.

According to the present invention in a second aspect, there is provided an extension edge arrangement of a carton comprising a base panel and a side wall, the arrangement comprising a compound fold between the base panel and the side wall.

Suitably, the base panel is foldably connected to the side wall via the compound fold.

Suitably, the compound fold is configured whereby the side wall is offset from the edge of the base panel. This provides an extension edge.

Suitably, the compound fold comprises a base panel marginal flange and a side wall marginal flange, both of which marginal flanges are substantially longer than the offset of the side wall from the edge of the base panel.

Suitably, the compound fold is secured to the base panel.

According to a third aspect of the present invention, there is provided a one-piece "book pack" type carton.

Suitably, the carton comprises a body portion having a plurality of side walls and a plurality of corners and a cover portion, in which the corner constructions are formed between the side walls and wherein the cover portion includes a lid foldably attached to a side wall.

Suitably, the side wall to which the lid is attached also comprises the "spine" of the "book pack" type carton.

Another difficulty in producing a one-piece "book pack" type carton is in relation to the corner construction at the corners adjacent the spine. If the lid is used to provide flaps or flanges from the corners, arrangements such as in U.S. Pat. No. 5,586,717 become necessary.

According to the present invention in a fourth aspect, there is provided a corner construction for a carton comprising a base panel, a first side wall foldably connected to the base panel, adjacent the first side wall a second side wall foldably connected to the base panel and means for securing the side walls relative to one another whereby the securing means secures the first side wall in a configuration at an acute angle with respect to the base panel thereby to at least partially deform the second side wall.

The intention is for the deformation of one side wall to be used to reduce the deformation of the other. This can be used to minimise the negative aesthetic effect of the deformation because the deformed wall can be selected by design.

Suitably, the securing means comprises a web between the first and second side walls, which web is folded to draw the first side wall to an acute angle with respect to the base panel at the corner with the second side wall.

Suitably, the web connects the first and second side walls.

Suitably, the third and fourth aspects of the invention are modified according to the first and/or second aspects of the invention.

According to the present invention in a fifth aspect, there is provided a corner construction of a carton comprising a base panel, a first side wall, a second side wall adjacent the first side wall and means for interengaging the first side wall and the second side wall.

This provides an arrangement that is easy to assemble, but secure and which requires minimal or no gluing.

Suitably, the interengaging means comprise a tongue of the first side wall adapted to fit in a slot of the second side wall.

Suitably, the slot is formed in a flap attached to the second side wall. Suitably, the slot flap is a marginal flange of the second side wall and is foldably attached thereto.

Suitably, the tongue is formed of a flap attached to the first side wall. Suitably, the tongue flap is a marginal flange of the first side wall and is foldably attached thereto. In a preferred embodiment, a side wall return panel is foldably attached to the first side wall return panel and the tongue flap is foldably attached to the peripheral flange. More suitably the tongue flap is foldably attached to the peripheral flange via a further flap foldably attached to the peripheral flange.

Suitably, the tongue is biassed towards the second side wall. This bias can be achieved by the foldable attachment of the tongue to the first side wall panel, which may be via other panels.

Suitably, the fifth embodiment of the present invention is modified according to any one or more of the first through fourth aspects of the invention.

According to the present invention in a sixth aspect, there is provided a corner construction of a carton comprising a base panel, a first side wall panel extending from the base panel, a first side wall return panel and means for connecting the first side wall panel to a second wall panel, which connecting means is locatable between the first side wall panel and the first side wall return panel.

This makes for a far neater corner construction.

Suitably, the connecting means comprises a web between the first and second side wall panels, which web typically includes at least one fold thereon.

Suitably, the web comprises two generally triangular segments separated by a fold line.

Suitably, the first side wall return panel extends from the end of the first side wall panel distant from the base panel for substantially the height of the first side wall panel and may further comprise a peripheral flange foldably connected thereto to lie generally parallel to the base panel.

Suitably, the second side wall panel is foldably attached to the base panel.

It will be appreciated that the features of the invention described above in relation to the second to sixth aspects of the invention may be utilised in applications other than "book pack" type cartons.

According to the present invention in a seventh aspect, there is provided a "book pack" type carton comprising an extension edge according to the second or third aspects of the present invention, and/or a corner construction according to the fourth, fifth or sixth aspects of the present invention.

BRIEF DESCRIPTION OF THE DRAWINGS

The present invention will now be described, by way of example only, with reference to the accompanying drawings; in which.

DESCRIPTION OF THE PREFERRED EMBODIMENTS

Figure 1:
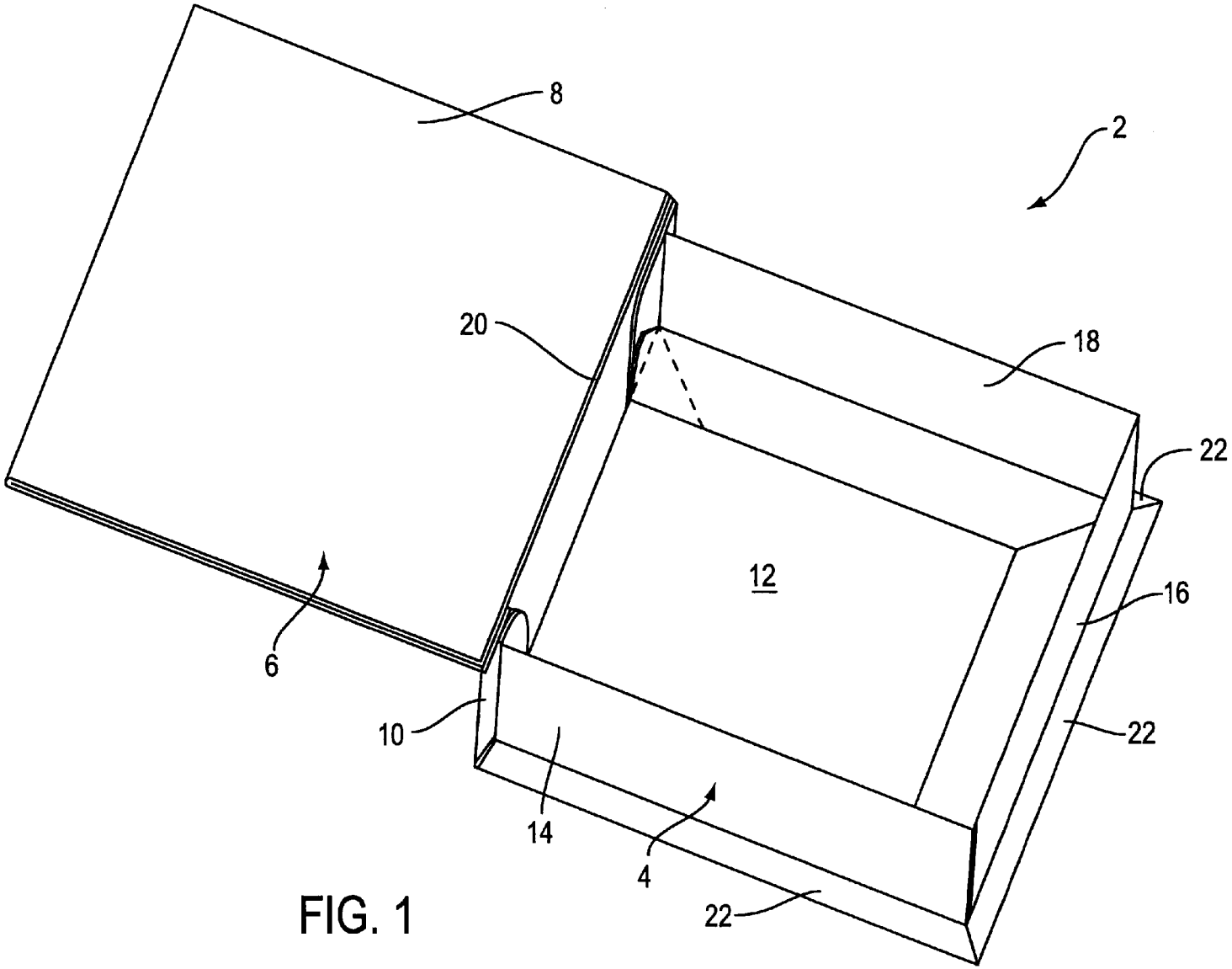
FIG. 1 is a schematic isometric illustration of a "book pack" type carton according to the present invention.

In the drawings, edges are shown by full lines and creases/scores by dashed lines.

Referring to FIG. 1 of the drawings, there is shown a "book pack" type carton 2 of one-piece construction. The carton 2 comprises, as one piece of carton board, a body portion 4 and an outer cover 6. Carton board is a rigid material capable of receiving scores or creases, and being folded thereon. The outer cover 6 comprises a lid 8, a spine 10 and a base panel 12. The body portion 4 shares base panel 12 and comprises three side walls 14, 16, 18. Side walls 14 and 18 extend from spine 10 at a right angle. Side wall 16 links side walls 14 and 18. The spine panel 10 forms the fourth side wall defining a cuboidal body portion 4. The lid 8 is hingedly moveable about its edge 20 at which there is a fold line.

The outer cover 6 defines an extension ledge 22 beyond body portion 4 to help create the "book" appearance.

Figure 2:
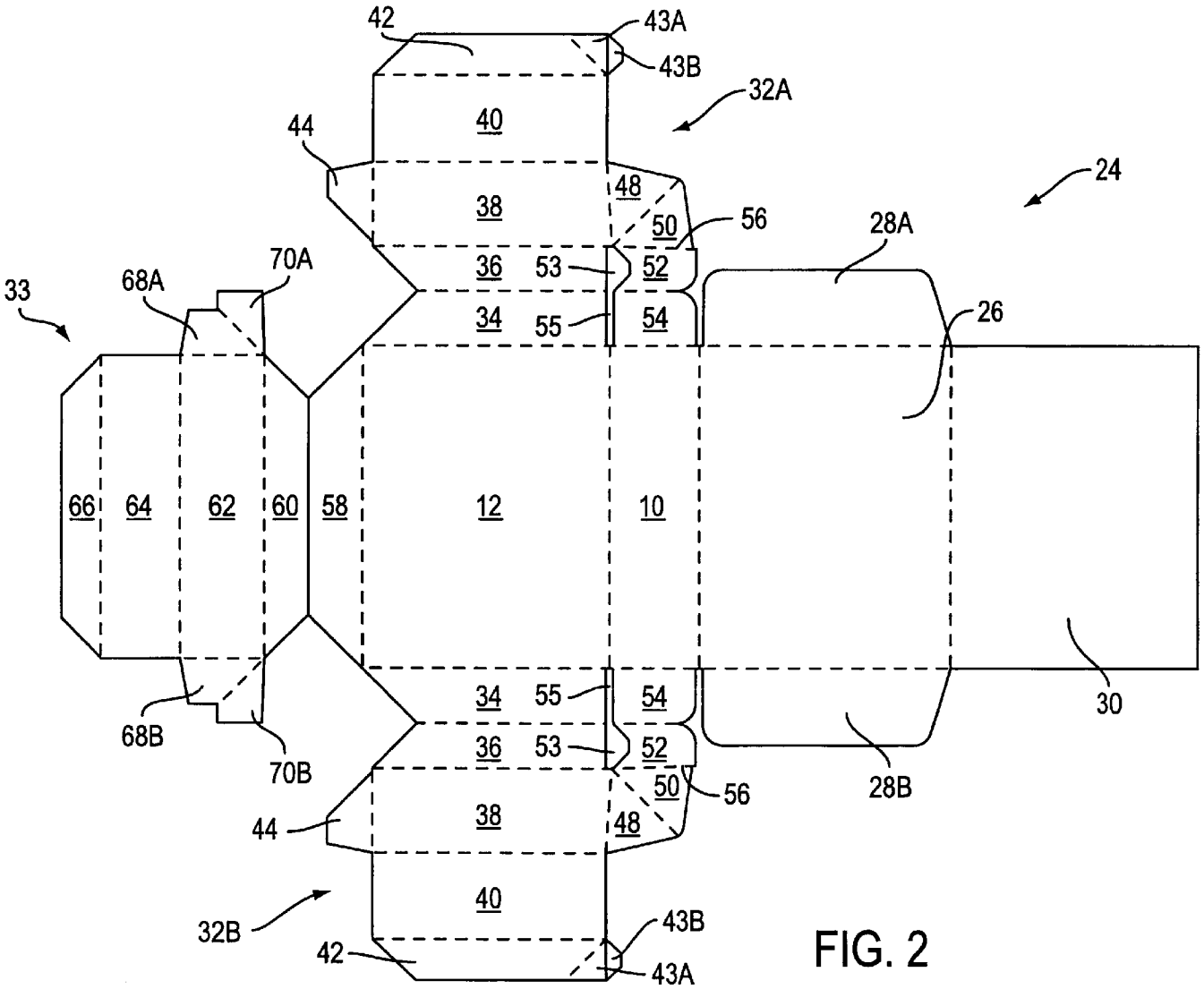
FIG. 2 is a plan view of a carton blank for producing the carton of FIG. 1.

Referring to FIG. 2 of the drawings, there is shown a blank 24 from which the carton 2 of FIG. 1 can be produced.

The lid 8 of carton 2 comprises a lid outer panel 26, flaps 28*a* and 28*b* foldably connected thereto, and a lid inner panel 30 foldably connected to lid outer panel 26.

Lid inner panel 30 is foldably connected to spine panel 10 which is foldably connected to base panel 12.

Extending from base panel 12 are two substantially similar side wall constructions 32*a* and 32*b* respectively. For ease of reference, only one of the side wall constructions 32*a*/*b* is described, with corresponding reference numerals being used for the other side wall construction 32*b*/*a*.

A further side wall construction 33, opposite lid 8 and adjacent side wall constructions 32*a* and 32*b* is also shown and described in more detail below.

Side wall construction 32*a* comprises a first marginal flange 34 foldably connected to base panel 12. First marginal flange 34 is foldably connected to second marginal flange 36 (by a reverse score). Second marginal flange 36 is foldably connected to a side wall panel 38, which in turn is foldably connected to a side wall return panel 40. Side wall return panel 40 is foldably connected to a peripheral flange 42.

Connected to peripheral flange 42 is a locking tongue 43 comprising a triangular flap 43*a* and a tab 43*b*. Flap 43*a* is foldably connected to peripheral flange 42 and by a reverse score to tab 43*b*.

Extending from and foldably connected to an end of side wall panel 38 towards side wall construction 33 is a tongue flap 44. Foldably connected to the other end of side wall panel 38 is a corner web arrangement 46.

The corner web arrangement 46 comprises a first triangular shaped segment 48, a second triangular shaped segment 50, a first slotted segment 52 and a second slotted segment 54, segments 48, 50 and 52 are, respectively, foldably connected to their respective adjacent segments 50, 52 and 54. A reverse score is formed between first and second triangular shaped segments 48, 50 respectively and between first and second slotted segments 52, 54 respectively. First triangular segment 48 is foldably connected to side wall panel 38. Second slotted segment 54 is foldably connected to spine panel 10. It is noted that the fold line 56 between the first slotted segment 52 and the second triangular segment 50 is not parallel to the fold lines of the side panel 38 or to base panel 12.

First slotted segment 52 includes a truncated triangular shaped slot indicated at 53. Second slotted segment 54 includes an elongate slot indicated at 55.

Side wall construction 33 will now be described. The side wall construction 33 comprises a first marginal flange 58 foldably connected (by a reverse score) to base panel 12. First marginal flange 58 is also foldably connected to a second marginal flange 60 which is foldably connected to side wall panel 62, which is foldably connected to side wall return panel 64, which is foldably connected to peripheral flange 66. Extending from each end of side wall panel 62 is a tongue 68*a*, 68*b* with corresponding locking flap 70*a*, 70*b* respectively foldably attached thereto.

An example of a mode of construction of the blank 24 will now be described. It will be appreciated that the order of construction can be altered.

Flaps 28*a* and 28*b* are folded over onto outer lid panel 26 and glued thereto. Inner lid panel 30 is folded over and glued onto flaps 28*a*, 28*b* and onto outer lid panel 26. This illustrates the simplicity of assembly of the lid.

With respect to side wall construction 32*a*, first marginal flange 34 is folded onto and glued to base panel 12 while second slotted segment 54 is folded onto and glued to spine 10. Second marginal flange 36 is folded onto and glued to first marginal flange 34 while first slotted segment 52 is folded onto and glued to second slotted segment 54. In this configuration, first and second triangular segments 48, 50 respectively form a flexible web allowing the spine panel 10 to move hingedly relative to base panel 12.

Next the spine panel 10 and side wall panel 38 are folded and brought together to be substantially perpendicular to base panel 12. This brings the two triangular segments 48, 50 together by virtue of the folds between them. The triangular segments 48, 50 are folded to lie against the internal face of side wall panel 38. Side wall return panel 40 is then folded over the triangular segments 48, 50 to be generally in a face to face relationship with side wall panel 38 and peripheral flange 42 overlies second marginal flange 36. Tab 43*b* of locking tongue 43 is then inserted into shaped slot 53. The thickness of the tab 43*b* and the bias provided by the reverse score between flap 43*a* and tab 43*b* allow the tab 43*b* and shaped slot 53 to interengage, thereby to secure the side wall 14 in place relative to spine panel 10 and base panel 12.

An equivalent operation is carried out on side wall construction 32*b* to assemble side wall 18.

Side wall construction 33 is assembled in a similar manner. First marginal flange 58 is glued to base panel 12 and second marginal flange 60 is glued to first marginal flange 58.

Tongues 68*a*, 68*b* are folded against the internal face of side wall panel 64. Tongue flaps 44 of side wall constructions 32*a* and 32*b* are folded over to overlie tongues 68*a*, 68*b*. Locking flaps 70*a*, 70*b* fold over tongue flaps 44 to help secure them in place. Side wall 16 is finally held in position by side wall return panel 64 being folded onto and glued to side wall panel 64, and to the revealed parts of tongues 44 and locking flaps 70*a*, 70*b*.

The removal of material for the slots 53 and 55 helps reduce the amount of excess material in the corner construction, thus reducing bulging.

In less preferred embodiments the first and second marginal flanges 34, 36 respectively and 58, 60 respectively need not be glued together.

The arrangement of the construction, in use, is described in more detail below.

Figure 3:
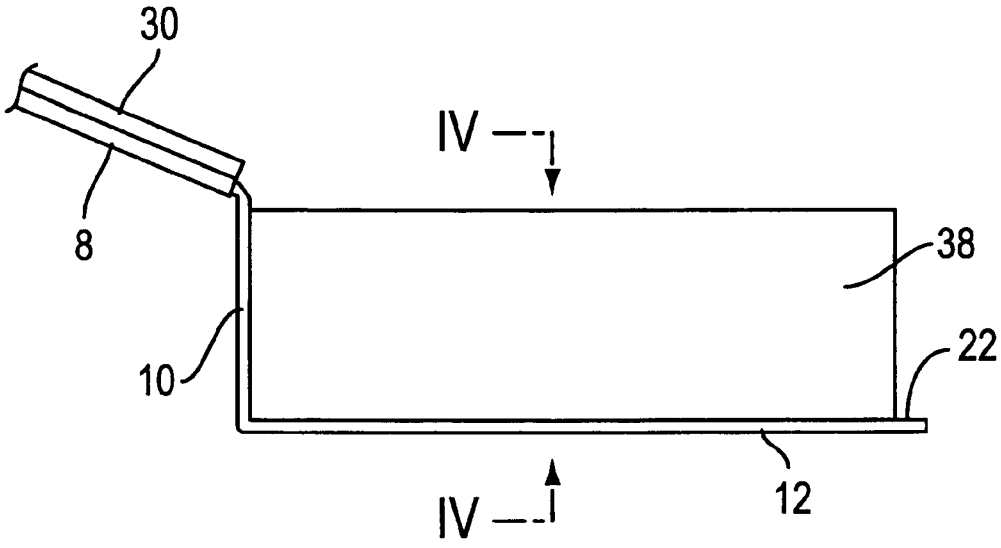
FIG. 3 is a schematic front elevation of the carton of FIG. 1.
Figure 4:
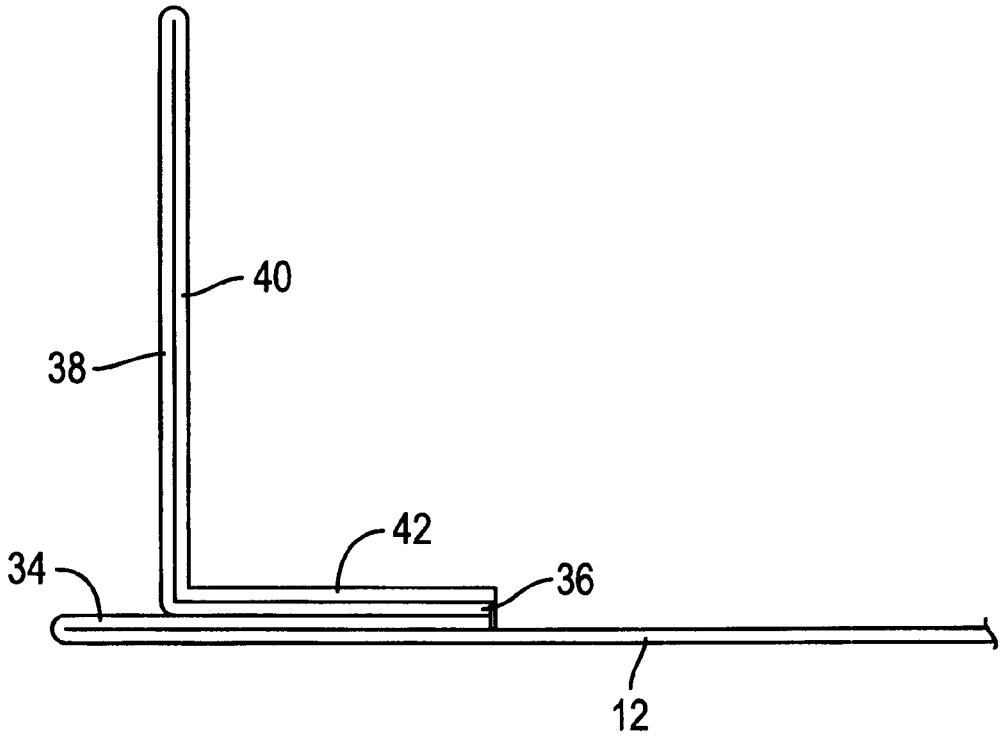
FIG. 4 is an enlarged schematic cross-sectional illustration on the line IV—IV in FIG. 3.
Figure 5:
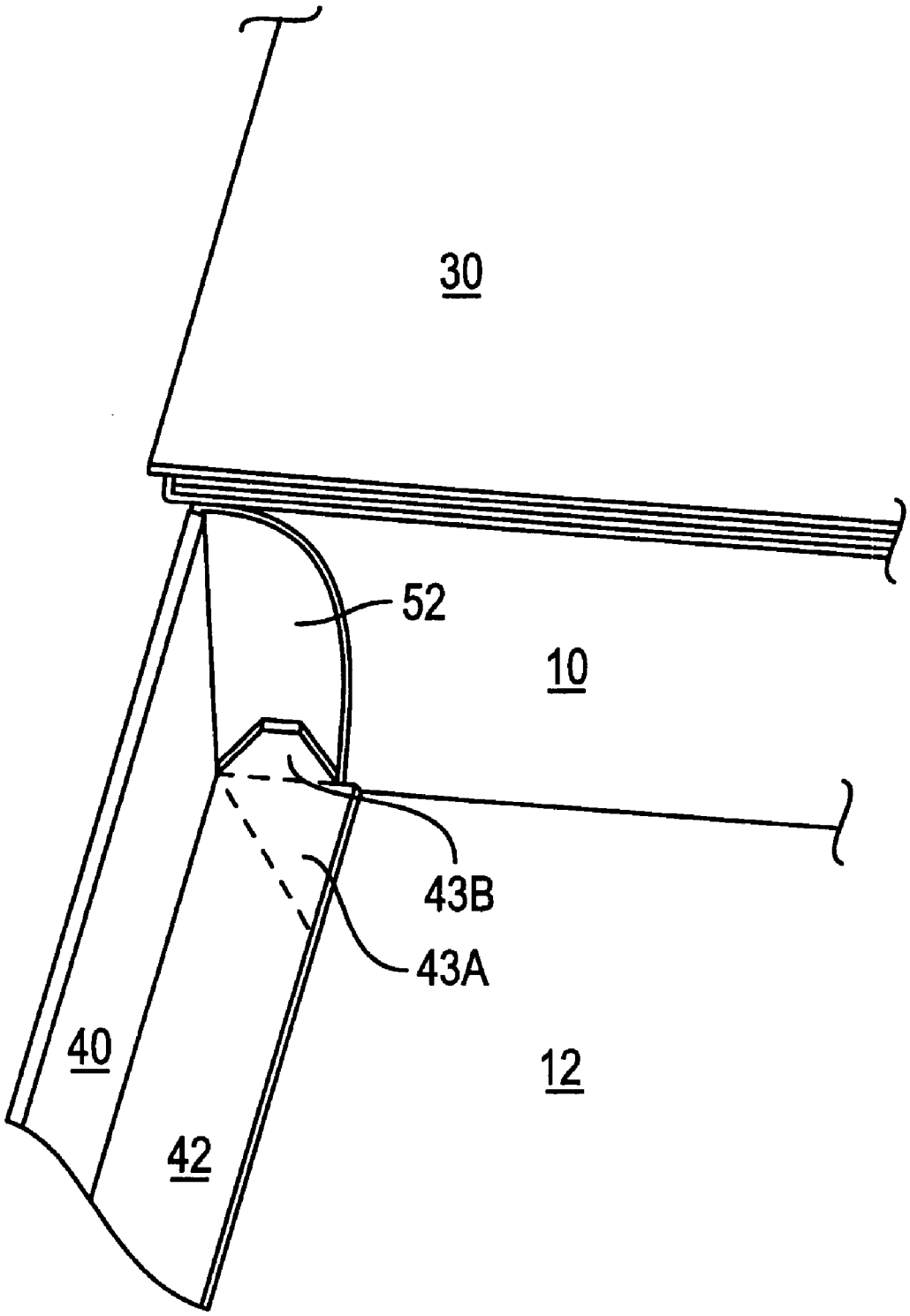
FIG. 5 is an enlarged schematic isometric view of the carton of FIG. 1, showing a corner construction.

As shown in FIGS. 3 and 4, the base panel 12 extends beyond side wall 38. Marginal flange 34 is in face to face relation with base panel 12, and returns under side wall panel 38 a considerable distance towards the interior of the body portion 4. Second marginal flange 36 returns to side wall panel 38. Second marginal flange 36 is also in face to face contact with first marginal flange 34. To avoid a raw edge, side wall return panel 40 runs back down from the top of side wall panel 38. Side wall return panel 40 is in a face to face relationship with side wall panel 38. Peripheral flange 42 is in a face to face relationship with second marginal flange 36 and extends an equal distance towards the centre of body portion 4. It is noted that the reverse score between first marginal flange 34 and second marginal flange 36 creates an abrupt fold with a flat edge as opposed to the softer rounded edge generated by the fold between base panel 12 and first marginal flange 34.

Due to the fact that the first marginal flange extends a substantial distance beyond side wall panel 38, allowing there to be a significant length of second marginal flange 36, little strain is exerted on the edge arrangement and plenty of area is provided for gluing. The additional area for gluing makes automation easier and ensures secure attachment of the various panels.

Manufacture of the blank and of the carton therefrom can therefore more easily be automated.

The angle of fold 56 between second triangular segment 50 and first slotted segment 52 helps maintain spine 10 at a perpendicular angle to base panel 12 when the carton 2 is constructed. The reason for this is because the angle of fold 56 draws side wall panel 32 to form an acute angle with respect to base panel 12 (measured within body portion 4), ie to pull it past the vertical. By virtue of the connection between side wall panel 32 and spine panel 10, the latter is deformed, ie pulled inwards. However, without the deformation, the spine panel 10 would bulge outwards because of the excess material in the corner construction. As the end of the spine panel 10 is visible near the corner (unlike the side wall 14), the deformation of side wall 14 is less noticeable than would have been the bulge in spine panel 10. The angle of fold 56 is chosen to deform spine panel 10 to the vertical with respect to base panel 12.

While the "webbed" corner construction described herein has advantages, and is referred to in aspects of the present invention, other constructions can be used. For instance, a glued tab can be used. Equally, two interlocking flanges could be provided with/without adhesive.

Although the Figures only show a cuboidal body portion, it will be appreciated that other shapes can be produced using features of the present invention.

It will be appreciated that features of the described embodiments are not necessarily limited to "book pack" type cartons.

What is claimed is:

1. A carton having an extension edge, said carton comprising: a base panel having an outer portion and a side wall generally perpendicular to the base panel, the base panel including a marginal flange foldably connected to the outer portion of the base panel, the marginal flange overlying the base panel, the side wall including a marginal flange foldably connected thereto, the side wall marginal flange overlying the base panel marginal flange, the base panel marginal flange being secured to the base panel or to the side wall marginal flange and being integrally and foldably connected to the side wall marginal flange.

2. A carton according to claim 1, wherein the base panel marginal flange extends beyond the side wall marginal flange.

3. A carton according to claim 2, wherein the base panel marginal flange extends from a first side of the side wall to substantially beyond a second side of the side wall.

4. A carton according to claim 1, wherein the carton is of a one-piece construction.

5. A carton having an extension edge, said carton comprising: a base panel having an edge, a side wall that is offset from the edge, and means for providing a compound fold between the base panel and the side wall, the means including a base panel marginal flange and a side wall marginal flange, both marginal flanges being substantially longer than the offset of the side wall from the edge of the base panel.

6. A carton according to claim 5, wherein the base panel is foldably connected to the side wall via the compound fold.

7. A carton according to claim 5, wherein the compound fold is secured to the base panel.

8. A carton according to claim 5, wherein the carton is a one-piece book pack carton which has an external appearance that resembles a book.

9. A carton according to claim 5, further comprising a plurality of additional side walls, means for joining the side walls at a plurality of corners, and a lid foldably attached to one of the side walls.

10. A carton according to claim 9, wherein the carton is a one-piece book pack carton which has an external appearance that resembles a book having a spine, and wherein the side wall to which the lid is attached serves as the spine of the book pack carton.

* * * * *